US005177400A

United States Patent [19]

Iwasaki

[11] Patent Number: 5,177,400

[45] Date of Patent: Jan. 5, 1993

[54] PROJECTION CATHODE-RAY TUBE

[75] Inventor: Yasuo Iwasaki, Nagaokakyo, Japan

[73] Assignee: Mitsubishi Denki Kabushiki Kaisha, Tokyo, Japan

[21] Appl. No.: 695,348

[22] Filed: May 3, 1991

[30] Foreign Application Priority Data

May 9, 1990 [JP] Japan ..... 2-120783

[51] Int. Cl.[5] ..... H01J 1/70; H01J 29/10

[52] U.S. Cl. ..... 313/466; 313/473; 313/474; 313/489; 313/112; 358/250; 358/253

[58] Field of Search ..... 313/466, 473, 474, 112, 313/489; 358/250, 253

[56] References Cited

U.S. PATENT DOCUMENTS 4,633,133 12/1986 Khurgiy ..... 313/474
4,634,926 1/1987 Vriens .
4,642,695 2/1987 Iwasaki .
4,647,818 3/1987 Vriens et al. ..... 313/474
4,683,398 7/1987 Vriens et al. ..... 313/474

FOREIGN PATENT DOCUMENTS 0246696 11/1987 European Pat. Off. .
3151326A1 7/1983 Fed. Rep. of Germany .
212359 8/1984 Fed. Rep. of Germany .
4033665A1 4/1991 Fed. Rep. of Germany .
0211854 8/1989 Japan ..... 313/489
1389737 4/1975 United Kingdom .
2149203 6/1985 United Kingdom .

OTHER PUBLICATIONS

"Radiation Damage in Projection CRT Glass" to A. Rengan et al, *Proceedings of the SID*, vol. 26/I, 1985.

*Primary Examiner*—Donald J. Yusko
*Assistant Examiner*—N. D. Patel

[57] ABSTRACT

A projection cathode-ray tube includes a transparent protective layer interposed between a face panel and an optical multilayered interference film. In order to prevent a browning discoloration from occurring on the glass surface of the face panel caused by a direct chemical reaction between the glass surface and the optical multilayered interference filter due to an electron bombardment, the transparent protective layer, made from inorganic materials, is disposed between the face plate and the optical multilayered interference filter. The transparent protective layer is made of silicon dioxide ($SiO_2$) or aluminum oxide ($Al_2O_3$), and has a thickness of 0.05 micrometer or less, or 0.5 micrometer or more, respectively.

9 Claims, 3 Drawing Sheets

PROJECTION CATHODE-RAY TUBE

BACKGROUND OF THE INVENTION

1. Field of the Invention:

This invention relates to a projection type cathode-ray tube having an optical multilayered interference film, and more particularly to a projection cathode-ray tube which prevents a discoloring phenomenon (hereinafter called as "browning") of the inner surface of a face panel.

2. Description of the Related Art:

A first related art is exemplified by U.S. Pat. No. 4,642,695 which is owned by the inventor of this invention. This U.S. Pat. No. 4,642,695 discloses a method for improving the low efficiency of gathering luminous flux into a projection lens unit from respective monochromatic projection cathode-ray tubes in a projection type television set.

In practice, in an ordinary cathode-ray tube, although the luminous flux emitted from a phosphor screen is nearly a so-called perfectly diffused light, among the luminous flux emitted from the phosphor screen only the luminous flux in the region having a divergent angle of +/−30 degrees is converged into the projection lens unit and is utilized effectively, while the remaining luminous flux becomes disregarded.

This disregarded luminous flux is reflected by a tube mirror and turned to be a stray light, impairing the contrast of the projected image. This first related art being set forth above aimed to overcome the above-mentioned drawbacks, whereby it became possible to enhance the brightness of an image on a screen of the projection type television set by converging the luminous flux in the excess 30% of total luminous flux emitted from an emission point on the phosphor screen into a cone having the divergent angle of +/−30 degrees.

To achieve the aim of the above-described first related art, another related art is exemplified by Japanese Patent Publication Laid-open No. 60-257043 also filed by the same inventor.

This second related art discloses a projection cathode-ray tube having a plurality of optical multilayered interference films composed of a plurality of alternately superimposed layers of a high-refractive-index film and a low-refractive-index film, and proposes the use of the optical multilayered interference film composed of six high-refractive-index layers consisting of tantalum oxide ($Ta_2O_5$) and the low-refractive-index layers consisting of silicon oxide ($SiO_2$). According to this second related art, it is possible to realize an angular distribution of brightness in luminous flux of the phosphor screen, and consequently a high quality projection cathode-ray tube can be obtained.

However, the following two drawbacks have been found in conjunction with the above-stated related art.

Specifically, regarding the second related art, in spite of the foregoing advantages, one drawback has been that the output of luminous flux emitted from the projection cathode-ray tube having the multilayered interference film is very much decreased as operating time elapses as compared with the deterioration that occurred in the projection cathode-ray tube without the optical interference film.

A rate of deterioration in output of the luminous flux emitted from the cathode-ray tube will now be explained.

FIG. 2 of the accompanying drawings illustrates a variation of the output of the luminous flux with the elapse of operating time when a projection cathode-ray tube for a green luminous flux is continuously operated at a high voltage (acceleration voltage) of 32 kV and a current density of 6 $\mu A/cm^2$ on the phosphor screen. Here, assume that in either case an outer surface of the face panel of the projection cathode-ray tube is cooled by a coolant.

In FIG. 2, a curved line III is a line representative of deterioration in light output of the projection cathode-ray tube without the optical multilayered interference film and shows that the output of the luminous flux is decreased to 74% of the initial output with the elapse of 7,000 hours of operating time.

As major factors of this deterioration phenomenon, there are enumerated a degradation in luminous efficiency of phosphors and a discoloring phenomenon known as browning of the inner surface of the face panel.

As of yet, each of these factors is considered to contribute to this deterioration at a ratio of fifty-fifty. Column A of table 1, as will be described later, shows a rate of deterioration in light output due to the degradation in phosphors and a rate of deterioration in light output due to the browning discoloration of the inner surface of the face panel, respectively. In this table, the initial value is defined as 100%, and each value is represented by a ratio of a light output value to the initial light output defined as 100%.

As is evident from the result shown in the table, it is considered that the degradation in luminous efficiency of the phosphors is caused by the gradual destruction of the luminance mechanism of the phosphors due to the energy of the electron bombardment and due to heat and X-rays caused when the electrons collide.

The browning discoloration is substantially classified into two types, that is, an electron browning and an X-ray browning.

The former browning occurs by alkali metal ions such as sodium (Na) and potassium (K), which constitute the face panel, which are reduced and metalized by the energy caused when the electrons which traveled through the gap in the phosphor layer directly collide with the inner surface of the face panel.

The latter browning is a kind of solarization, and is caused by the occurrence of a discoloring center at a lattice defect in the surface glass of the face panel due to the X-ray energy generated when the electrons make a collision with the phosphor screen and the glass surface at high velocity.

Both the electron browning and the X-ray browning cause the glass of the face panel to be discolored. As is apparent from FIG. 3, a spectral transmissivity distribution (b), after discoloration, shows a steeper slope of the transmissivity curve in the shorter wavelength region of visible light as compared with a spectral transmissivity distribution (a) before discoloration.

A curved line II in FIG. 2 represents a slope of degradation in light output of the projection cathode-ray tube (conventional type 2) having the optical multilayered interference film.

In the structure of the conventional cathode-ray tube (2) as shown in FIG. 4, the face panel 1 has on its inner surface the optical multilayered interference film 2 made up of five thin alternately superimposed layers of a high-refractive-index film of titanium dioxide ($TiO_2$) and a low-refractive-index film of silicon dioxide ($SiO_2$), and the phosphor layer 3 and the metal back layer 4 are disposed over the multilayered interference film.

As described above, in accordance with the conventional projection cathode-ray tube 2, as can be seen from the curved line (II) of FIG. 2, the light output dropped to 63% of the initial light output value with the elapse of 7,000 hours of operating time, and the curve of degradation in light output is far steeper than the slope of the curved line (III) of the foregoing conventional projection cathode-ray tube 1. A factorial experiment of this result is illustrated in column B of the table 1.

Naturally, since the presence of the optical multilayered interference film has no correlation with the degradation of the phosphors, the light output of the projection cathode-ray tube in accordance with the present invention has the same value as that of the conventional projection cathode-ray tube 1 without the optical multilayered interference film.

Further, the optical multilayered interference film itself is subjected to the browning, and consequently the light output of the cathode-ray tube is dropped by 5%. Here, attention should be given to the fact that the decrease in light output is due to the browning on the glass surface.

Namely, in the case of the conventional projection cathode-ray tube 1 without the optical multilayered interference film, the drop rate of the light output from the cathode-ray tube due to the browning on the glass surface of the face panel is 14%, whereas that of the conventional cathode-ray tube 2 having the optical multilayered interference film is 23%.

Thus, the light output is much deteriorated by the cathode-ray tube having the multilayered interference film as compared with the deterioration by the cathode-ray tube without the multilayered interference film.

Originally, the optical multilayered interference film coats the glass surface and serves to weaken the energy of the electrons which collide with the glass surface. Accordingly, the browning discoloration of both the electron browning and the X-ray browning is subsequently expected to be diminished.

However, as seen from the result in the table 1, in the case of the conventional cathode-ray tube 2 having the optical multilayered interference film, the browning on the glass surface of the face panel is conversely increased.

In the study of causes of the increase of browning in the conventional projection cathode-ray tube 2 having the optical multilayered interference film, it is found that browning of the glass surface of the face panel is increased by a mechanism, as will be described later.

In short, in the case of the conventional cathode-ray tube 2, as shown in FIG. 4, the optical thin film layer of high-refractive-index of titanium dioxide ($TiO_2$) is deposited on the glass surface of the face panel 1 as a first optical layer.

Since the optical multilayered interference film 2 set forth has five layers and has a thickness of 0.5 to 0.7 micrometer, the electrons travelling through the gap of the phosphor screen 3 penetrate through the optical multilayered interference film 2 and can reach the region of the glass surface of the face panel 1.

During this time, the optical thin film layer of titanium dioxide ($TiO_2$), formed over the glass surface of the face panel 1, is subjected to the electron bombardment, and consequently titanium dioxide ($TiO_2$) is reduced to titanium monoxide (TiO) by the removal of an oxygen (O) therefrom. The titanium monoxide (TiO) is highly unstable and acquires oxygen (O) from the glass surface of the face panel 1 so as to be a stable titanium dioxide ($TiO_2$).

Since sodium oxide ($Na_2O$) and potassium oxide ($K_2O$) are present in the form of ions, sodium ions and potassium ions are turned into a sodium metal and a potassium metal by a reducing reaction when oxygen (O) is removed. With this result, the browning discoloration is considered to be accelerated. Particularly, when as in many cases, the first layer of the high refractive index film is made from metal oxides.

Through a research of various metal oxides practicable in view of their optical property, it was found in more or less all metal oxides studied that a browning discoloration occurs to some extent.

SUMMARY OF THE INVENTION

The present invention aims to overcome the foregoing drawbacks in the prior art and to suppress the browning discoloration of the glass surface of the face panel of the projection cathode-ray tube having the optical multilayered interference film. An object of the invention is to provide a projection cathode-ray tube which can reduce the deterioration in light output with time.

To this aim, in accordance with one aspect of the present invention, there is provided a projection cathode-ray tube comprising: a face panel; a phosphor layer; an optical multilayered interference film composed of a plurality of alternately superimposed layers of high and low refractive index materials; and a transparent protective layer interposed between the optical multilayered interference layer and the face panel, whereby a browning discoloration, which occurs on the inner surface of a face plate that is brought into contact with the optical multilayered interference film due to the electron bombardment energy, is reduced and a light output is enhanced.

According to the projection cathode-ray tube embodying the present invention, since the transparent inorganic material film which does not function as the optical thin film layer is interposed between the optical multilayered interference film and the face panel, even if the unstable titanium monoxide (TiO) is produced by the collision of electrons against the titanium dioxide ($TiO_2$) of the first optical thin film layer, the titanium monoxide cannot acquire oxygen (O) directly from the glass surface.

Therefore, sodium oxide ($Na_2O$) and potassium oxide ($K_2O$), both of which are present in the glass of the face panel in the form of sodium ions and potassium ions are not turned into sodium metal and potassium metal, thereby preventing the browning discoloration of the glass surface.

BRIEF DESCRIPTION OF THE ACCOMPANYING DRAWINGS

The novel features believed characteristic of the invention are set forth in the appended claims. The invention itself, however, as well as other features and advantages thereof, will be best understood upon making reference to the detailed description which follows, read in conjunction with the accompanying drawings wherein like numerals denote like parts and wherein:

DETAILED DESCRIPTION OF THE PREFERRED EMBODIMENTS

In the following, one embodiment of the present invention will be described with reference to the accompanying drawings.

Figure 1:
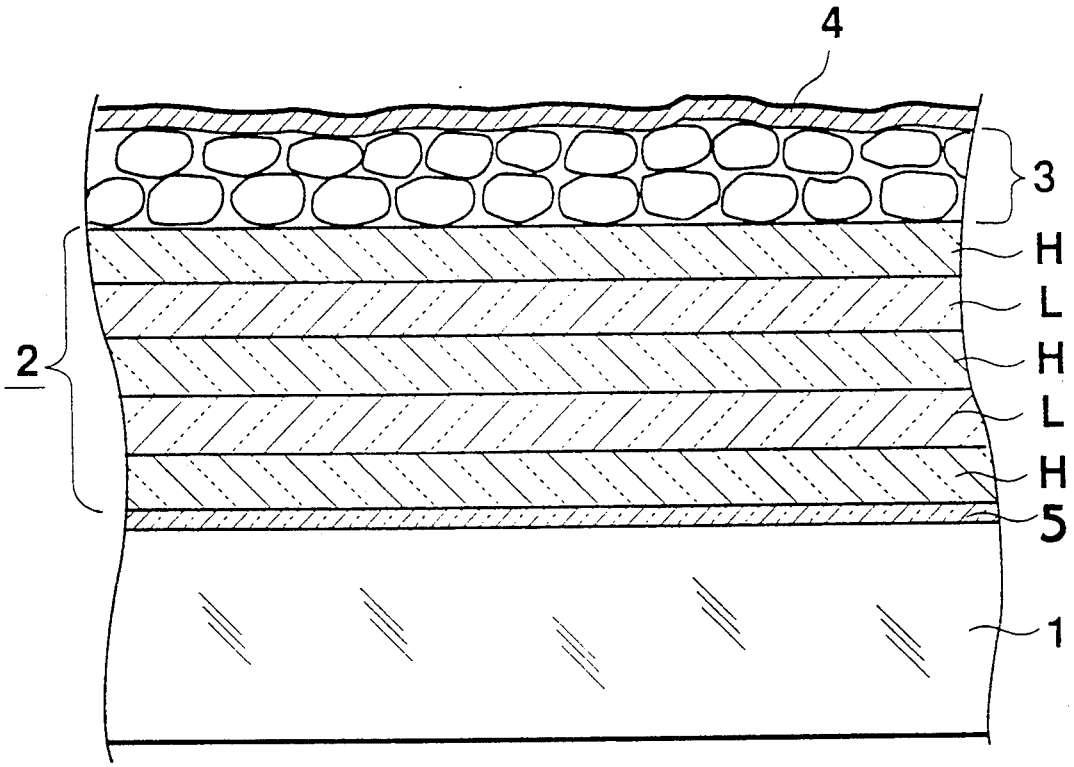
FIG. 1 is a cross sectional plan view diagrammatically illustrating the face panel and the phosphor screen of a projection cathode-ray tube having an optical multilayered interference film in accordance with one embodiment of the present invention.

FIG. 1 is a cross sectional plan view showing the face panel and the phosphor screen of a projection cathode-ray tube having an optical multilayered interference film in accordance with one embodiment of the present invention.

In FIG. 1, between a metal back layer 4 and a phosphor layer 3 is interposed an optical multilayered interference film 2 composed of five thin alternately superimposed layers of high and low refractive index films. The high refractive index film is composed of titanium dioxide ($TiO_2$) and the low refractive index film is composed of silicon dioxide ($SiO_2$).

In the case of the projection cathode-ray tube according to the embodiment being set forth, a transparent inorganic material film 5 which does not function as the optical thin film layer is interposed between the optical multilayered interference film 2 and the face panel 1.

In this structure, the transparent inorganic material film 5 serves as a barrier for preventing the optical thin film layer of titanium dioxide ($TiO_2$), a high-refractive-index film, from effecting a chemical reaction directly with the glass surface of the face panel 1 by virtue of the electron energy.

Specifically, if an unstable titanium oxide (TiO) is generated by the removal of an oxygen (O) of titanium dioxide ($TiO_2$) due to the bombardment energy caused when the electrons penetrate through the phosphor layer 3 and reach the first layer of titanium dioxide ($TiO_2$) on the face panel side 1, titanium oxide (TiO) cannot acquire oxygen (O) directly from the glass surface of the face panel 1 as in the conventional cathode-ray tube because a transparent inorganic material film 5, for instance a silicon dioxide ($SiO_2$), stable to the electron bombardment, is disposed as a barrier layer between the glass surface of the face panel 1 and the optical multilayered interference film.

Accordingly, it becomes possible to reduce the browning discoloration on the glass surface. If the transparent inorganic material film 5 functions as an optical thin film layer, such functioning may affect the optical property of the optical multilayered interference film 2.

In order to eliminate any influence upon the optical property, this transparent inorganic material film must be sufficiently thicker than that of the optical thin film, otherwise, it must be sufficiently thinner. If silicon dioxide ($SiO_2$) or aluminum oxide ($Al_2O_3$) is used as the transparent inorganic material film 5, these materials are preferably formed to have a thickness of 0.05 micrometer or less or a thickness of 0.5 micrometer or more, respectively.

By the use of an experimentally fabricated projection cathode-ray tube having an optical multilayered interference film and a transparent inorganic material film composed of silicon dioxide ($SiO_2$) with a thickness of 0.03 micrometer, there is obtained a variation of the light output with operating time when the cathode-ray tube is continuously operated under the condition of a high voltage (at an acceleration electrode) of 32 kV and a current density of 6 $\mu A/cm^2$.

Figure 2:
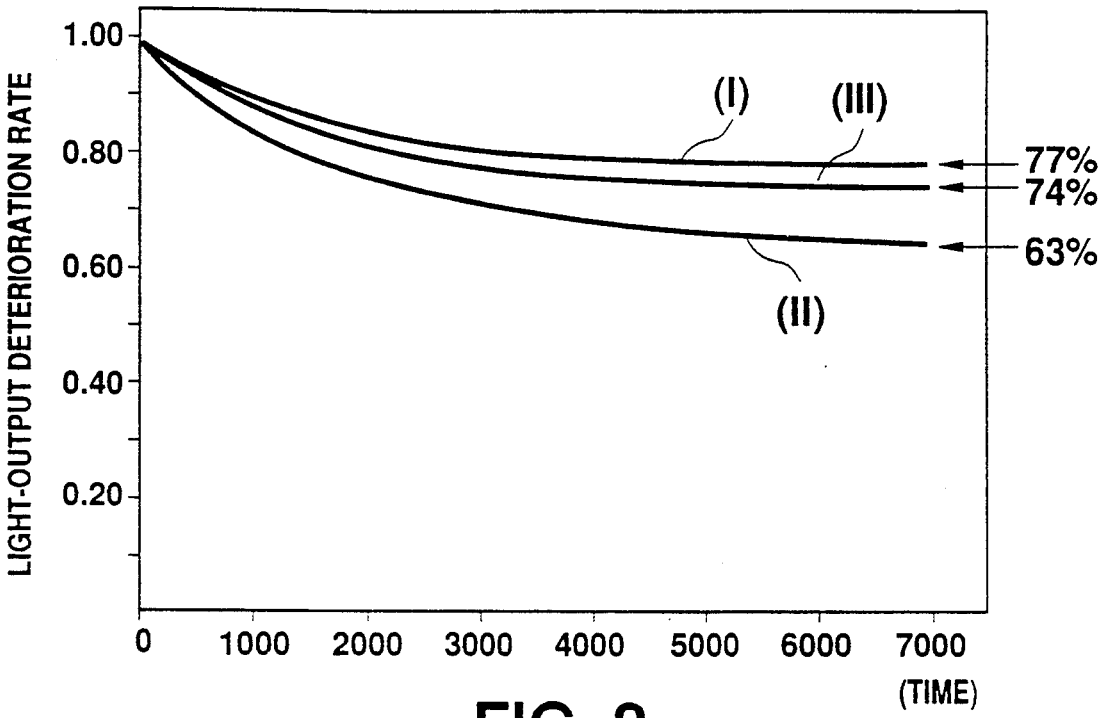
FIG. 2 is a characteristic diagram showing the deterioration in light output with time of the projection cathode-ray tube of FIG. 1.
Figure 3:
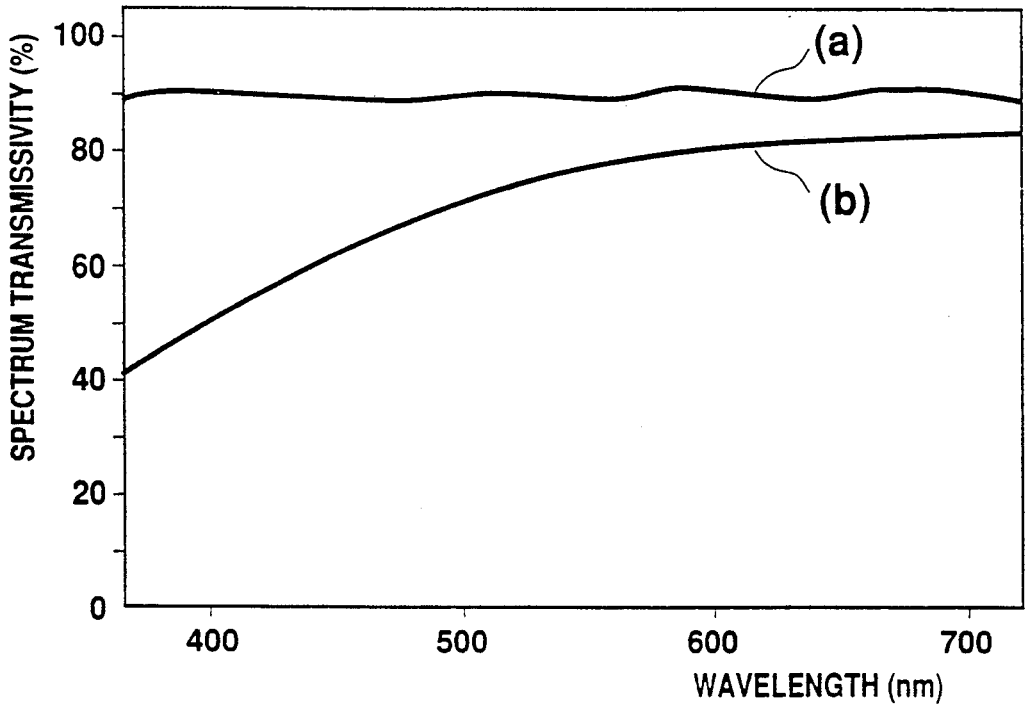
FIG. 3 is a characteristic diagram showing variations of spectral transmissivity due to a browning discoloration of the glass surface of the face plate.
Figure 4:
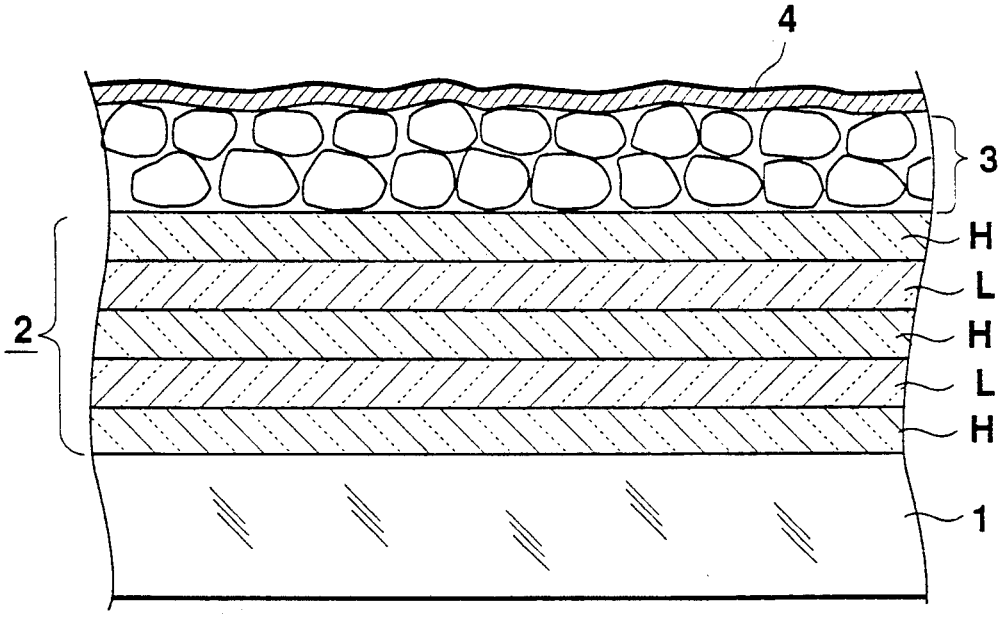
FIG. 4 PRIOR ART
FIG. 4 is a cross sectional plan view illustrating the face panel and the phosphor screen of a conventional projection cathode-ray tube having an optical multilayered interference film.

With the review of the obtained result represented by a curved line I of FIG. 2, the browning phenomenon on the glass surface of the face plate is suppressed and the slope of deterioration in light output also indicates 77% of the initial light output with the elapse of 7,000 hours of operating time.

From this result, it is proven that the projection cathode-ray tube in accordance with the present invention produces a better result than that obtained by the conventional cathode-ray tube 1 in Table 1, whose deterioration rate in light output is 74% of the initial light output.

The reason behind this result is that a direct chemical reaction, due to the electron energy, between the optical thin high-refractive-index film layer of titanium dioxide ($TiO_2$) and the glass surface of the face panel is prevented by the barrier effect of the transparent inorganic material film. The factorial experiment of the deterioration in light output indicated by the curved line I of FIG. 2 is shown in a column C of the table 1.

As is apparent from the results listed in the table, in the cathode-ray tube embodying the present invention, the deterioration in light output due to the browning discoloration on the glass surface of the face panel is remarkably improved as compared with the conventional cathode-ray tubes 1 and 2.

This result is produced by a synergetic effect of the barrier effect of the optical multilayered interference film which reduces the electron energy causing the browning discoloration on the glass surface of the face panel, and the barrier effect of the transparent inorganic material film which prevents a direct chemical reaction due to the electron energy between the optical thin high-refractive-index film layer of titanium dioxide ($TiO_2$) and the glass surface of the face panel.

The reason why the curved line representing the deterioration in light output due to the browning shows a decline lower than that in the columns A and B of the table 1 is considered to be that oxygen (O) has not been supplied to the optical thin film layer of titanium dioxide ($TiO_2$).

As alternatives for the aforementioned transparent inorganic material film, material such as oxides, fluorides and sulfides consisting of inorganic elements are considered to be usable as well as silicon dioxide ($SiO_2$) and aluminum oxide ($Al_2O_3$).

As has been described, in accordance with this invention, since the projection cathode-ray tube having the optical multilayered interference film includes the transparent inorganic material film interposed between the first layer of the optical thin film layer and the glass surface of the face panel, this inorganic material film acts as a barrier to reduce the browning discoloration occurring on the glass surface of the face panel, whereby it becomes possible to produce a high quality projection cathode-ray tube having less deterioration in light output with time.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is, therefore, contemplated that the appended claims will cover any such modifications or embodiments as fall within the true scope of the invention.

TABLE 1

| | (A) Conventional Projection Cathode-ray Tube 1 Without optical multilayered interference film | (B) Conventional Projection Cathode-ray Tube 2 With optical multilayered interference film | (C) Projection Cathode-ray Tube embodying this invention having an optical multi-layered interference film |
|---|---|---|---|
| Light-output deterioration due to degradation in phosphors | 0.86 | 0.86 | 0.86 |
| Light-output deterioration due to glass surface browning | 0.88 | 0.77 | 0.96 |
| Light-output deterioration due to browning of multilayered interference film | — | 0.95 | 0.93 |
| Total light-output (Ratio of light output to initial light output) | 0.74 | 0.63 | 0.77 |

What is claimed is:

1. A projection cathode-ray tube comprising:

(a) a face panel;

(b) a phosphor layer;

(c) an optical multilayered interference filter disposed between said face panel and said phosphor layer, and composed of a plurality of alternately superimposed layers of high and low refractive index material; and (d) a transparent protective layer interposed between said optical multilayered interference filter and said face panel to provide a barrier for preventing the optical multi-layered interference filter from chemically reacting with the face panel upon contact with electron energy to thereby reduce browning on the face panel.

2. A projection cathode-ray tube according to claim 1, wherein said transparent protective layer includes silicon dioxide ($SiO_2$).

3. A projection cathode-ray tube according to claim 1, wherein said transparent protective layer includes aluminum oxide ($Al_2O_3$).

4. A projection cathode-ray tube according to claim 2, wherein said transparent protective layer has a thickness of at most 0.05 micrometer.

5. A projection cathode-ray tube according to claim 2, wherein said transparent protective layer has a thickness of at least 0.5 micrometer.

6. A projection cathode-ray tube according to claim 3, wherein said transparent protective layer has a thickness of at most 0.05 micrometer.

7. A projection cathode-ray tube according to claim 3, wherein said transparent protection layer has a thickness of at least 0.5 micrometer.

8. A projection cathode-ray tube according to claim 1, wherein at least one high refractive index material layer includes titanium dioxide ($TiO_2$).

9. A projection cathode-ray tube according to claim 1, wherein at least one low refractive index material layer includes silicon dioxide ($SiO_2$).

* * * * *